US009363616B1

(12) United States Patent
Chu et al.

(10) Patent No.: US 9,363,616 B1
(45) Date of Patent: Jun. 7, 2016

(54) DIRECTIONAL CAPABILITY TESTING OF AUDIO DEVICES

(71) Applicant: Rawles LLC, Wilmington, DE (US)

(72) Inventors: Wai Chung Chu, San Jose, CA (US); Steve Anthony Quento, San Jose, CA (US); Robert Gregory Deacon, Pescadero, CA (US); Colter Earl Cederlof, San Jose, CA (US); Steve Gil Gonzalez, Los Gatos, CA (US); Philip Ryan Hilmes, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 133 days.

(21) Appl. No.: 14/256,839

(22) Filed: Apr. 18, 2014

(51) Int. Cl.
*H04R 29/00* (2006.01)

(52) U.S. Cl.
CPC ..... *H04R 29/00* (2013.01)

(58) Field of Classification Search
CPC ..... H04R 29/00
See application file for complete search history.

(56) References Cited

U.S. PATENT DOCUMENTS 5,729,612 A * 3/1998 Abel ..... H04R 29/001 381/1
7,418,392 B1 8/2008 Mozer et al.
7,720,683 B1 5/2010 Vermeulen et al.
7,774,204 B2 8/2010 Mozer et al.
2012/0223885 A1 9/2012 Perez
2012/0243697 A1* 9/2012 Frye ..... H04R 29/00 381/58

FOREIGN PATENT DOCUMENTS

WO WO2011088053 A2 7/2011

OTHER PUBLICATIONS

Pinhanez, "The Everywhere Displays Projector: A Device to Create Ubiquitous Graphical Interfaces", IBM Thomas Watson Research Center, Ubicomp 2001, Sep. 30-Oct. 2, 2001, 18 pages.

* cited by examiner

*Primary Examiner* — Sonia Gay
(74) *Attorney, Agent, or Firm* — Lee & Hayes, PLLC

(57) ABSTRACT

A test system for testing directional capabilities of an audio device includes a horizontal linear actuator and a vertical linear actuator. The horizontal linear actuator supports a rotary actuator upon which the audio device is placed. The vertical linear actuator supports a sound source. To test the device, the actuators are controlled to establish multiple relative positions of the audio device and the sound source. A test sound is emitted at each of the relative positions. The audio device is configured to provide data generated in response to the test sound at each of the relative positions. The test system receives and records the data along with coordinates indicating the relative positions to which the data corresponds.

21 Claims, 2 Drawing Sheets

DIRECTIONAL CAPABILITY TESTING OF AUDIO DEVICES

BACKGROUND

Certain types of devices may use audio processing techniques to determine positional information about sound sources and/or to produce audio signals that emphasize sound from certain positions or directions. When developing and implementing such techniques, it is often desired to test their effectiveness and accuracy.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

This disclosure relates to systems and techniques for testing the directional capabilities of audio devices. Directional capabilities may include beamforming and sound source localization, for example. Beamforming and sound source localization rely on differences in arrival times of sound at different microphones. Beamforming shifts and combines signals produced by the microphones in such a way as to reinforce sounds coming from one direction while deemphasizing sounds coming from other directions. Sound source localization analyzes phase differences in the signals to determine the directions or positions from which sounds originate.

In order to test the performance of audio devices that utilize position-dependent audio processing techniques, a mechanism is provided for positioning an audio device and a sound source at different relative positions, for emitting sound from the sound source at each of the relative positions, and for recording data produced by the audio device at each of the relative positions in response to the emitted sound.

The mechanism has a horizontal linear actuator configured to move the audio device horizontally. A rotary actuator is configured to rotate the audio device about a vertical axis. A vertical linear actuator configured to move the sound source vertically. The horizontal linear actuator is controlled to establish the horizontal distance of the sound source relative to the audio device. The rotary actuator is controlled to establish the azimuth of the sound source relative to the audio device. The vertical linear actuator is controlled to establish the altitude or elevation of the sound source relative to the audio device.

A controller is configured to select and establish the relative positions of the sound source and the audio device through control of the actuators, to emit a test sound at each of the relative positions through control of the sound source, and to record data produced by the audio device in response to the sound emitted at each of the relative positions. This results in test data having multiple records. Each record comprises (a) coordinates specifying the actual relative position of the sound source and audio device and (b) data produced by the audio device in response to the sound emitted at the relative position. The test data records can be analyzed during or after their acquisition to determine accuracy or validity of the provided data. The data records may also be analyzed to calibrate or determine characteristics of the audio device.

In some embodiments, the data produced by the audio device may comprise audio signals, such as the audio signals generated by each of the multiple microphones of the audio device or directional audio signals generated by beamforming. In other embodiments, the data may comprise positional data corresponding to each relative position, such as coordinates of the relative position of the sound source as calculated by the audio device.

Figure 1:
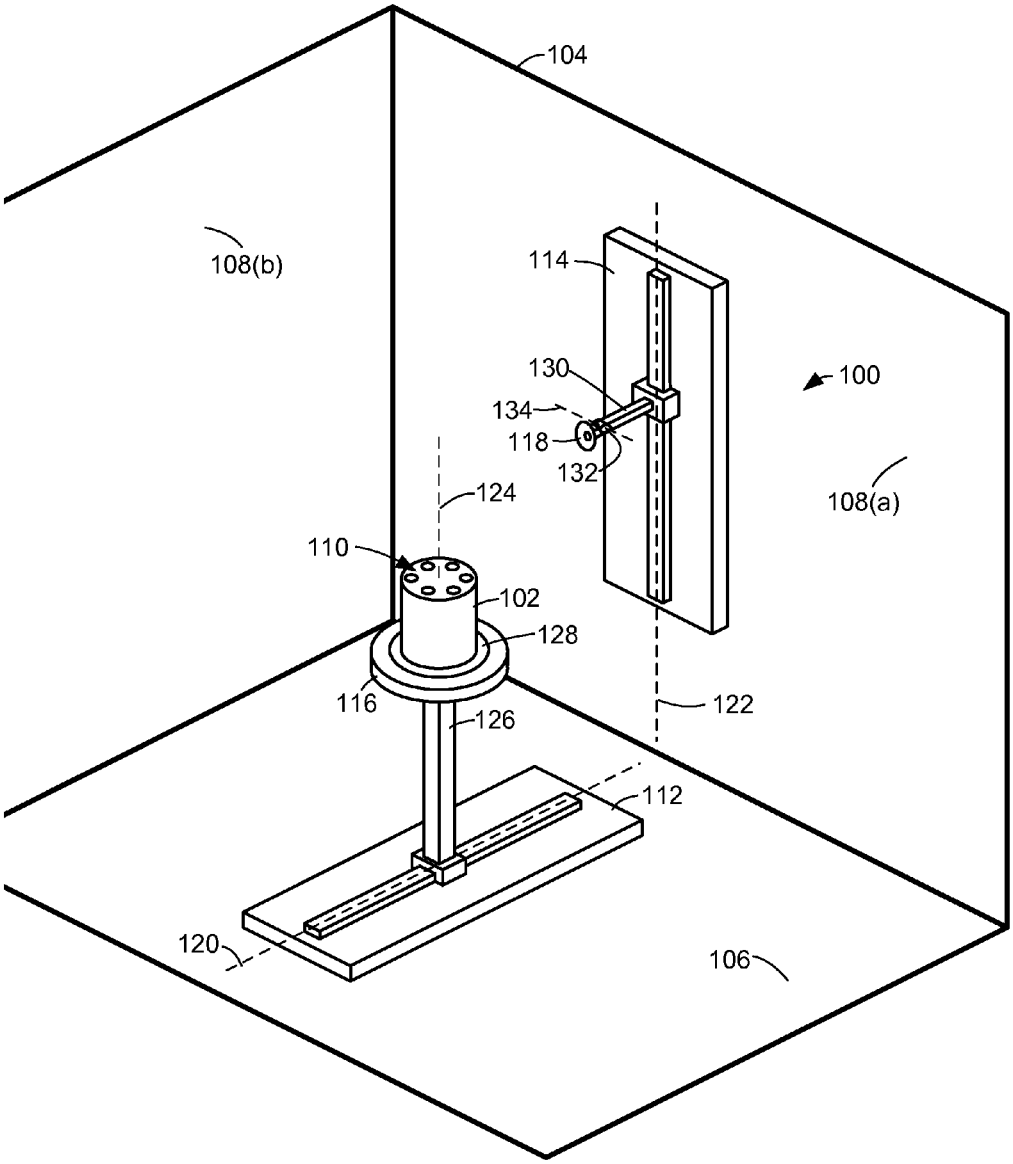
FIG. 1 is an isometric view of an example system for testing directional capabilities of audio devices.

FIG. 1 shows an example of a system or mechanism 100 that may be used to test audio processing capabilities of an audio device 102, to gather data relating to performance of the audio device 102, and/or to calibrate components of the audio device 102. The system 100 is shown as being mounted or housed in a room 104 having a floor 106 and walls 108. In some embodiments the room 104 may be treated to optimize sound characteristics for testing purposes. For example, the walls may be overlaid with a sound dampening material such as acoustic foam.

The audio device 102 has multiple microphones 110 that are spaced from each other for use in conjunction with beamforming and/or sound localization. In the illustrated example, the microphones 110 are positioned within a single, horizontal plane. However, different types of audio devices may utilize microphone arrays in which individual microphones or microphone elements are arranged linearly or in three dimensions. In some embodiments, the audio device may have only a single microphone 110.

In the embodiment of FIG. 1, the system 100 comprises a horizontal linear actuator 112, a vertical linear actuator 114, and a rotary actuator 116. The audio device 102 is supported and moved by the horizontal linear actuator 112 and the rotary actuator 116. A sound source 118 is supported and moved by the vertical linear actuator 114.

The horizontal linear actuator 112 rests on or is mounted to the floor 106 and configured to move along a horizontal axis 120 parallel to the floor and perpendicular to the wall 108(*a*). The vertical linear actuator 114 is mounted to the wall 108(*a*) and configured to move the sound source 118 along a vertical axis 122 that is parallel to the wall 108(*a*) and perpendicular to the floor 106. The rotary actuator 116 is supported by and above the horizontal linear actuator 112. The rotary actuator 116 is configured to rotate the audio device 102 about a vertical axis 124.

Each of the horizontal and vertical linear actuators 112 and 114 may comprise a linear slide or other type of motorized or actuated linear motion mechanism. Each linear actuator may comprise a single slide rail as shown or may comprise a set of parallel slide rails. Various other types and configurations of linear motion mechanisms may be used.

The rotary actuator 116 may comprise a turntable or other type of rotary motion mechanism. The rotary actuator 116 may be supported by and above the horizontal linear actuator 112 by a support stand or frame 126.

The audio device 102 may be affixed to the rotary actuator 116 by means of a test fixture 128. The test fixture 128 may be configured to establish a fixed position and rotational alignment between the audio device 102 and the rotary actuator 116. The test fixture 128 may have fasteners, clamps, or other mechanisms for fixing the audio device to the rotary actuator 116. The test fixture 128 may be replaceable or interchangeable with different test fixtures to accommodate different types of audio devices 102.

The sound source 118 may be supported horizontally outwardly from the vertical linear actuator 114 by a support arm 130. The support arm 130 may in some embodiments have a pivot or pivot actuator 132 that allows the sound source 118 to be pivoted up and down about a horizontal axis 134 that is perpendicular to the vertical axis 122 of the vertical linear actuator 114. In some embodiments, the sound source 118 may comprise a sound transducer such as a conventional loudspeaker element. In other embodiments, the sound source 118 may comprise any other mechanism capable of producing sound, such as a mechanical clicker.

In the illustrated embodiment, the axes 120, 122, and 124 are in a common plane. The vertical axis 122 of the vertical linear actuator 114 intersects and is perpendicular to the horizontal axis 120 of the horizontal linear actuator 112. The vertical axis 124 of the rotary actuator 116 intersects and is perpendicular to the horizontal axis 120 of the horizontal linear actuator 112. The vertical axis 124 of the rotary actuator 116 is parallel to the vertical axis 122 of the vertical linear actuator 114.

In the illustrated embodiment, the vertical linear actuator 114 is configured and positioned so that the sound source 118 can be moved both above and below the audio device 102. The support stand 126 is used to elevate the audio device 102 above the floor 106 so that the sound source 118 can be moved below the horizontal plane of the audio device 102.

Figure 2:
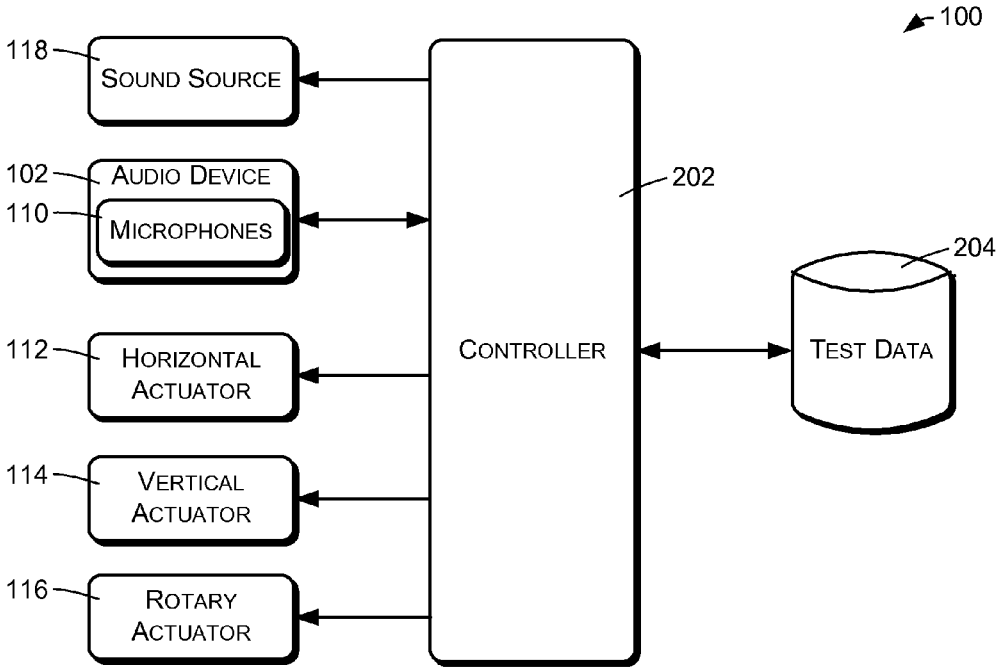
FIG. 2 is a block diagram illustrating a functional configuration of the example system shown in FIG. 1.

FIG. 2 illustrates an example functional configuration of the system 100. A controller 202 is configured to control movement of the actuators 112, 114, and 116 to position the audio device 102 and the sound source 118 at desired positions for testing. More specifically, the controller 202 controls the actuators 112, 114, and 116 to successively position the sound source 118 and the audio device 102 at multiple relative positions, which may include different azimuths, different altitudes, and/or different horizontal distances of the sound source 118 relative to the audio device 102. The controller 202 also controls the sound source 118 to emit a test sound at each of the relative positions.

The controller 202 is configured to communicate with the audio device 102 to coordinate data capture by the audio device 102. Specifically, the controller 202 may signal the audio device 102 to capture, produce, and/or provide test data 204 during times when the test sound is being emitted from the sound source 118. The controller 202 is also configured to receive the test data 204 from the audio device 102 and to record the test data 204. The test data may comprise multiple data records. Each data record of the test data 204 may comprise (a) coordinates indicating the actual position of the sound source relative to the audio device 102 and (b) device data produced and provided by the audio device 102 in response to the test sound being emitted at that position. In some embodiments, the test data 204 may include an audio signal corresponding to the test sound, such as a digital audio file that is rendered at the sound source 118 to produce the test sound. In some embodiments, the test data 204 may indicate a more general nature of the test sound, such as a number and timing of clicks or impulse sounds that are produced by the sound source 118.

The device data may comprise one or more audio signals, calculated coordinates, and/or other data relating to the functions of the audio device 102 that depend upon the position of the sound source 118 relative to the audio device 102. For example, the device data may comprise audio signals produced by or derived from the microphones 110 of the audio device 102 during the times that the test sounds are emitted by the sound source 118. As another example, the device data may comprise directional or beamformed audio signals produced by the audio device 102 during the times that the test sounds are emitted.

Alternatively, the device data may comprise parametric data calculated or obtained by the audio device 102 in response to the test sound emitted at each of the relative locations. For example, the device data may comprise coordinates of the sound source 118 as calculated by the audio device 102 using its sound source localization functionality. As another example, the device data may comprise calculated differences in arrival times of the emitted test sound at each of multiple microphones 110 of the audio device 102.

Figure 3:
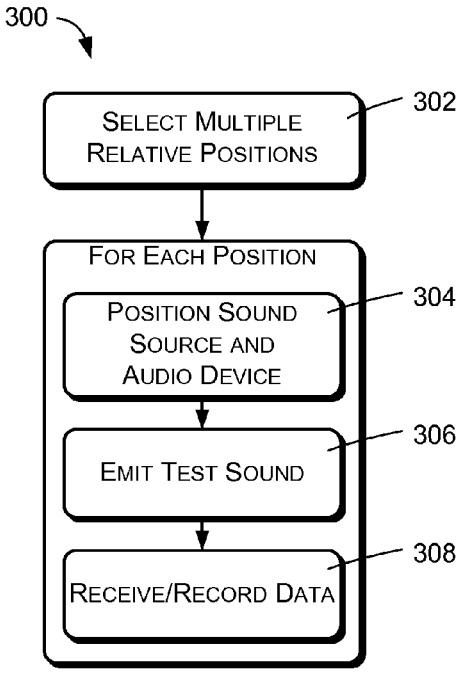
FIG. 3 is a flow diagram illustrating an example method of testing directional capabilities of audio devices in conjunction with the system illustrated by FIGS. 1 and 2.

FIG. 3 illustrates an example method 300 that may be performed by the system 100. The actions shown in FIG. 3 may in certain embodiments be performed, initiated, coordinated, or controlled by the controller 202.

An action 302 comprises selecting multiple relative positions of the audio device 102 and the sound source 118. Each relative position may be defined by coordinates representing (a) an azimuth of the sound source 118 relative to the audio device 102, (b) an altitude or elevation of the sound source 118 relative to the audio device 102, and (c) a horizontal distance between the sound source 118 and the audio device 102. Other types of coordinates may also be used to specify relative positions, such as XYZ Cartesian coordinates.

The positions may be selected in various ways, including by manual selection and automatic selection. In some embodiments, the positions may be selected at regular spacings. For example, the positions may be selected to form a regular grid in the three-dimensional space surrounding the audio device. In some cases, the positions may form an irregular grid having a higher position densities in certain regions or areas that or of relatively higher interest.

In some embodiments, the positions may be selected during testing based on earlier test results. For example, initial testing may find that certain regions are more critical than others to position changes or that results are relatively unreliable or inaccurate in certain regions. Position density may be increased in these areas. Similarly, testing at or around certain positions may be repeated when results are not as expected or are not uniform.

A set of actions 304, 306, and 308 are performed for every selected relative position. The action 304 comprises positioning the sound source 118 and the audio device 102 at the selected relative position by (a) moving the audio device along the horizontal axis 120, (b) rotating the audio device about the vertical axis 124, and (c) moving the sound source along the vertical axis 122. More specifically, a desired horizontal distance is established by moving the audio device 102 with the horizontal linear actuator 112 along the horizontal axis 120. A desired azimuth is established by rotating the rotary actuator 116 about the vertical axis 124. A desired elevation of the sound source 118 relative to the audio device 102 is established by moving the sound source 118 with the vertical linear actuator 114 along the vertical axis 122.

In some embodiments, the action 304 may also comprise pivoting the sound source 118 up or down about the horizontal axis 134 using the pivot actuator 132. This action may be performed in embodiments in which the sound source 118 is directional, so that the output of the sound source 118 is pointing directly toward the position of the audio device 102.

The action 306 comprises emitting the test sound at the selected relative position. In some embodiments, the sound source may comprise a loudspeaker and the controller 202 may generate a test sound and play the test sound on the loudspeaker. The test sound may in some cases comprise an impulse sound that the audio device 102 may attempt to localize. Other test sounds may comprise recorded voice, simulated voice, music, white noise, and so forth. In some cases, multiple noises or sounds may be played at each position. Furthermore, the sound source 118 may in some cases comprise multiple transducers, such as a loudspeaker and a clicking device. The action 306 may include emitting multiple test sounds at each relative position, such as audio from a loudspeaker and an impulse sound generated by a mechanical device.

The action 308 comprises receiving and recording test data from the audio device 102. The test data may comprise audio signals, audio waveforms, sound source localization data, position coordinates, directional parameters, filter parameters, time-difference-of-arrival (TDOA) data, intermediate parameters calculated by the audio device 102 when performing sound source localization or beamforming, and so forth. The test data may be recorded for each of the selected positions and saved for later analysis. Alternatively, the test data may be analyzed as it is received by the controller 202.

Figure 4:
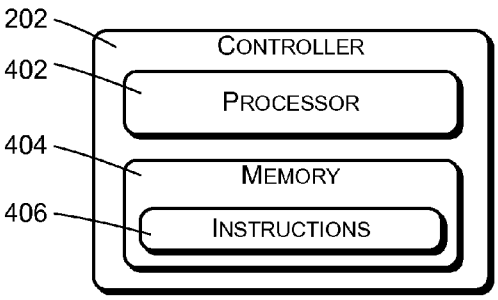
FIG. 4 is a block diagram showing relevant components of controller that may be configured to perform the example method of FIG. 3.

FIG. 4 shows relevant components of the controller 202 that may be used to implement the techniques described above. The controller 202 may have a processor 402 and memory 404. The processor 402 may include multiple processors and/or a processor having multiple cores.

The memory 404 may contain applications and programs in the form of computer-executable instructions 406 that are executed by the processor 402 to perform acts or actions that implement desired functionality of the controller 202, including the methods and functionality described above. The memory 404 may be a type of non-transitory computer-readable storage media and may include volatile and nonvolatile memory. Thus, the memory 404 may include, but is not limited to, RAM, ROM, EEPROM, flash memory, or other memory technology.

Although the subject matter has been described in language specific to structural features, it is to be understood that the subject matter defined in the appended claims is not necessarily limited to the specific features described. Rather, the specific features are disclosed as illustrative forms of implementing the claims.

The invention claimed is:

1. A system, comprising:

a controller configured to receive data from an audio device;

a first linear actuator that is responsive to the controller to move the audio device along a horizontal axis;

a rotary actuator that is responsive to the controller to rotate the audio device;

a sound source that is responsive to the controller to emit a test sound;

a second linear actuator that is responsive to the controller to move the sound source along a vertical axis that intersects the horizontal axis;

the controller being configured to perform actions comprising:

controlling the actuators to successively position the sound source and the audio device at multiple positions;

causing the sound source to emit the test sound at each of the positions; and receiving data produced by the audio device in response to the test sound emitted at each of the positions.

2. The system of claim 1, wherein the audio device has multiple microphones and the data comprises audio signals produced by the multiple microphones.

3. The system of claim 1, wherein the data comprises coordinates of the multiple positions as calculated by the audio device.

4. The system of claim 1, wherein the audio device has multiple microphones and the data comprises differences in arrival times of the test sound at each of the microphones.

5. The system of claim 1, further comprising a pivot actuator configured to pivot the sound source about a horizontal axis, the actions further comprising pivoting the sound source with the pivot actuator.

6. A device, comprising:

a controller configured to receive data from an audio device;

a first actuator that is responsive to the controller to move the audio device along a first axis;

a second actuator that is responsive to the controller to rotate the audio device about a second axis;

a sound source that is responsive to the controller to emit a test sound;

a third actuator that is responsive to the controller to move the sound source along a third axis, the third axis substantially perpendicular to the first axis;

the controller being configured to perform actions comprising:

successively positioning the sound source and the audio device at multiple positions with the actuators; and causing the sound source to emit the test sound at each of the positions.

7. The system of claim 6, further comprising a fourth actuator that is responsive to the controller to direct the sound source.

8. The system of claim 6, wherein the first, second, and third axes are within a common plane.

9. The system of claim 6, wherein:

the first and second axes intersect;

the second axis is perpendicular to the first axis;

the first and third axes intersect; and the third axis is parallel with the second axis.

10. The system of claim 6, wherein the controller is further configured to receive differences in arrival times of the test sound at multiple microphones of the audio device at each of the positions.

11. The system of claim 6, wherein the controller is further configured to collect data produced using one or more microphones of the audio device in response to the test sound being emitted at the multiple positions.

12. The system of claim 11, wherein the data comprises one or more audio signals produced by the one or more microphones of the audio device.

13. The system of claim 11, wherein the data comprises one or more beamformed audio signals produced by the one or more microphones of the audio device.

14. The system of claim 11, wherein the data comprises coordinates of the positions as calculated by the audio device.

15. A computer-implemented method, comprising:

successively positioning a sound source and an audio device at different positions using one or more actuators, the positioning comprises:

moving the audio device along a first axis;

rotating the audio device about a second axis; and moving the sound source along a third axis, the third axis is substantially perpendicular to the first axis;

emitting a test sound at each of the positions; and receiving data produced by the audio device at each of the positions in response to the test sound.

16. The method of claim 15, wherein positioning the sound source and the audio device further comprises pivoting the sound source about a fourth axis.

17. The method of claim 15, wherein the first, second, and third axes are within a common plane.

18. The method of claim 15, wherein:

the first and second axes intersect;

the second axis is perpendicular to the first axis;

the first and third axes intersect; and the third axis is parallel with the second axis.

19. The method of claim 15, wherein the data comprises one or more audio signals produced the audio device in response to the test sound emitted at each of the positions.

20. The method of claim 15, wherein the data comprises coordinates of the positions as calculated by the audio device in response to the test sound emitted at each of the positions.

21. The method of claim 15, wherein the data comprises differences in arrival times of the test sound at multiple microphones of the audio device at each of the positions.

* * * * *